United States Patent [19]

McCandless

[11] 4,298,818

[45] Nov. 3, 1981

[54] ELECTRON GUN

[75] Inventor: Harry E. McCandless, Lancaster, Pa.

[73] Assignee: RCA Corporation, New York, N.Y.

[21] Appl. No.: 70,738

[22] Filed: Aug. 29, 1979

[51] Int. Cl.[3] ..... H01J 29/50

[52] U.S. Cl. ..... 313/417; 313/289; 313/456

[58] Field of Search ..... 313/417, 409, 411, 444, 313/456, 457, 447, 299

[56] References Cited

U.S. PATENT DOCUMENTS

| | | |
|---|---|---|
| Re. 25,127 | 2/1962 | Szegho . |
| 2,170,663 | 3/1935 | Painter . |
| 2,202,588 | 6/1938 | Kniepkamp . |
| 2,375,815 | 5/1945 | Ohl . |
| 2,540,621 | 2/1948 | Johnson . |
| 2,735,032 | 2/1956 | Bradley . |
| 2,825,832 | 3/1958 | Cutter . |
| 2,975,315 | 3/1961 | Szegho . |
| 3,032,674 | 5/1962 | Schwartz . |
| 3,128,407 | 4/1964 | Mattson . |
| 3,164,426 | 1/1965 | Benway . |
| 3,345,527 | 10/1967 | Atti . |
| 3,383,537 | 5/1968 | Marshall . |
| 3,771,002 | 11/1973 | Standart . |

*Primary Examiner*—Palmer C. Demeo
*Assistant Examiner*—Darwin R. Hostetter
*Attorney, Agent, or Firm*—Eugene M. Whitacre; Dennis H. Irlbeck; Vincent J. Coughlin, Jr.

[57] ABSTRACT

The present invention is an improvement in a multi-beam electron gun for use in a cathode-ray tube. Such gun includes a plurality of cathode assemblies and at least two spaced successive electrodes having aligned apertures therein. The improvement comprises the cathode assemblies and the two electrodes being individually attached to a single ceramic member. The ceramic member is the sole supporting interconnection within the gun between the cathode assemblies and the two electrodes.

4 Claims, 6 Drawing Figures

ELECTRON GUN

BACKGROUND OF THE INVENTION

The present invention relates to an improved multibeam electron gun for a cathode-ray tube and particularly to an electron gun having improved stability between a plurality of cathode assemblies and two adjacent grid electrodes.

Electron guns, such as used in shadow mask type color picture tubes, are designed to generate and direct preferably three electron beams along convergent paths to a small area of convergence near a screen of a tube. Two general types of guns in most common use are the inline electron gun, wherein three beams are initiated at three points in a line and the delta electron gun, wherein three beams are initiated at the points of a triangle. Each of these types has three separate cathode assemblies and a series of electrodes spaced therefrom. The cathode assemblies and electrodes are held in place relative to each other by separate attachment to a plurality of glass rods. The electrode closest to the cathode assemblies is called the G1 and is usually a control grid. The next electrode is called the G2 and is usually a screen grid. The spacings between the cathodes and these two grids, as well as between the grids themselves, are very critical. For example, a change as small as 0.001 inch (0.025 mm) in the spacing between a cathode and the G1 may change the cutoff voltage of the electron gun by about 60 volts. Unfortunately, during warmup of a tube having a gun construction as previously described, the spacings between the cathodes, G1 and G2, vary to some extent. This variation in spacings causes unstable and nonuniform cutoff voltages for each of the beams in a gun thereby changing the colors which appear in the tube screen. This nonuniformity between beams requires additional circuitry for correction. It is desirable to develop a tube wherein any changes in the spacings between the cathode assemblies and the G1 and G2 electrodes during tube warmup are uniform.

SUMMARY OF THE INVENTION

The present invention is an improvement in a multibeam electron gun for use in a cathode-ray tube. Such gun includes a plurality of cathode assemblies and at least two spaced successive electrodes having aligned apertures therein. The improvement comprises the cathode assemblies and the two electrodes being individually attached to a single ceramic member. The ceramic member is the sole supporting interconnection within the gun between the cathode assemblies and the two electrodes.

DETAILED DESCRIPTION

Figure 1:
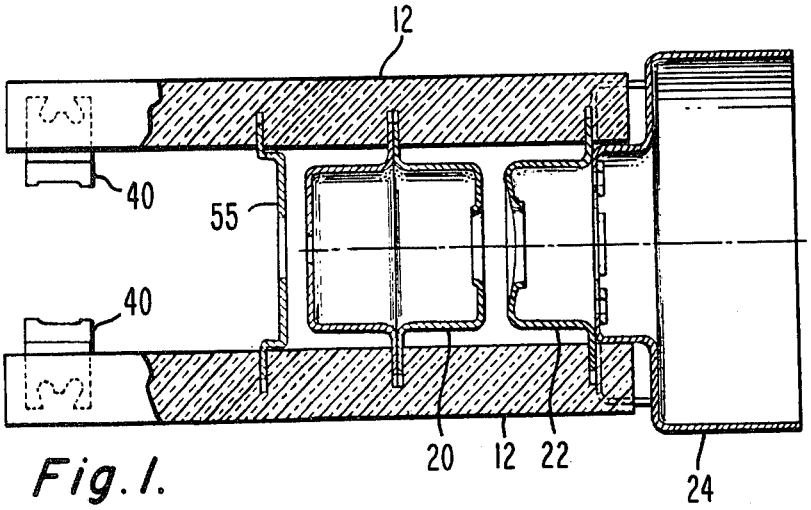
FIG. 1 is a sectional side view an electron gun without a cathode grid subassembly.
Figure 2:
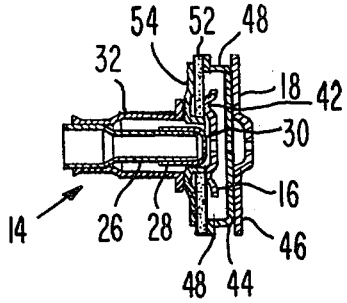
FIG. 2 is a sectional side view a cathode grid subassembly.
Figure 3:
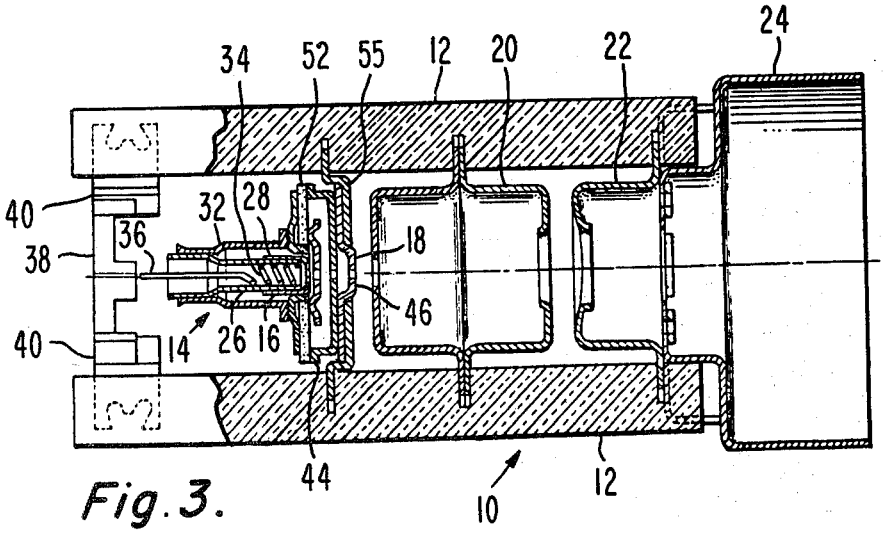
FIGS. 3 and 4 are a cutaway side view and a cutaway top view, respectively, of a complete electron gun wherein the subassembly of FIG. 2 has been inserted in the remaining gun portion of FIG. 1.
Figure 4:
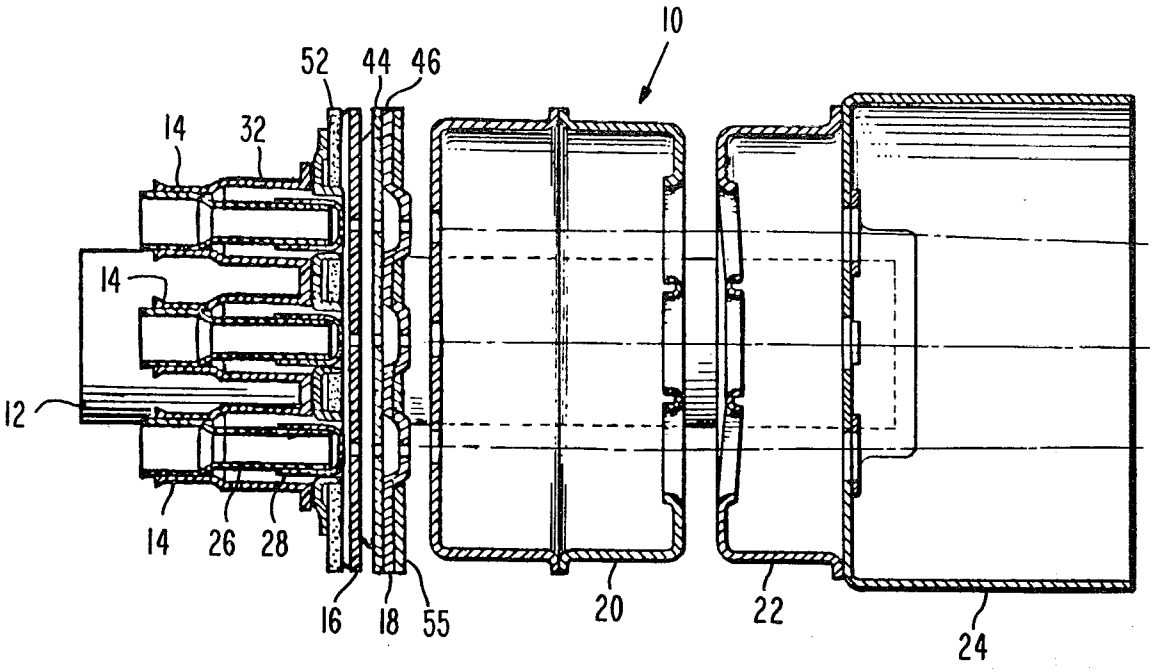

The details of an improved electron gun 10 are shown in FIGS. 1 through 4. FIGS. 1 and 2 each show a portion of the gun which when assembled together form the completed gun of FIGS. 3 and 4. The gun 10 comprises two glass support rods 12, also called beads, upon which various electrodes of the gun are mounted. These electrodes include three equally spaced inline cathode assemblies 14, one for each beam, a control grid electrode 16, a screen grid electrode 18, a first accelerating and focusing electrode 20, a second accelerating and focusing electrode 22 and a shield cup 24 spaced from the cathode in the order named.

Each cathode assembly 14 comprises a cathode sleeve 26 closed at the forward end by a cap 28 having an electron emissive coating 30 thereon. The cathode sleeves 26 are supported at their open ends within support tubes 32. Each cathode is indirectly heated by a heater coil 34 positioned within the sleeve 26. The heater coils 34 have legs 36 which are welded to heater straps 38 which in turn are welded to support studs 40 that are imbedded in the glass rods 12. The control and screen grid electrodes 16 and 18 are two closely spaced elements each having three aligned apertures centered with the cathode coatings 30. The control grid 16 is essentially a flat plate having a peripheral rib 42 extending around the three apertures. The screen grid 18 is formed from two elements 44 and 46. The first elements 44 is essentially a flat plate with two parallel flanges 48 extending therefrom. The second element 46 is also essentially a flat plate except that the central portion of it is slightly bulged away from the element 44. Both of the elements 44 and 46 have three apertures therein which are aligned with the apertures of the control grid electrode 16.

The cathode assembly 14 and the control and screen grid electrodes 16 and 18 are constructed as a separate subassembly 50, shown in FIG. 2. All three of these components are brazed to metalized areas on surfaces of a single wafershaped piece 52 of flat ceramic. The cathode assemblies 14 are connected to the ceramic wafer 52 via an annular member 54 which is brazed to one side of the ceramic wafer 52. The tube 32 of each cathode assembly is welded to the annular member 54. It should be noted that the tube 32 also could be welded directly to the ceramic wafer 52. The control grid electrode 16 is brazed to the opposite side of the ceramic wafer 52 along its peripheral rib 42. The screen grid electrode 18 is brazed to the ceramic wafer at the ends of the two parallel flanges 48. It can be seen that the spacing between the control, and screen grid electrodes 16 and 18 is directly related to the height of the peripheral rib 42 and the length of the flanges 48 since each contact the same flat surface of the ceramic wafer 52. Once the cathode sleeves 26 have been inserted into the support tubes 32 and the distance between the cathode coatings 30 and the control grid electrode 16 adjusted to that desired, the sleeves 26 are welded to the tubes 32 thus forming the completed subassembly 50, shown in FIG. 2. The subassembly 50 attaches to the remainder of the gun by welding the screen grid electrode 18 to a support bracket 55 that extends between the two glass rods 12.

The first accelerating and focusing electrode 20 comprises two rectangularly cup-shaped members 56 and 58 joined together at their open ends. The bottom portions of each member 56 and 58 have three apertures each which are aligned with the apertures of the control and screen grid electrodes 16 and 18. The second accelerating and focusing electrode 22 is also rectangularly cup-shaped with the open end of the electrode 22 facing away from the electrode 20. Three apertures also are in the electrode 22. The middle aperture is aligned with the adjacent middle aperture in the electrode 20. However, the two outer apertures are slightly offset outwardly with respect to the outer apertures of the electrode 20 to aid in convergence of the outer beams with the center beam. The shield cup 24, located at the output of the gun 10, has various coma correction members 60 located on its base around or near the electron beam paths.

It should be noted that the present invention centers around the subassembly 50 and that the remainder of the gun may vary greatly from that as shown. For example, the focusing portion of the gun may be as shown in U.S. Pat. No. 3,932,786 issued to F. J. Campbell on Jan. 13, 1976 which discloses a resistive lens gun or as in U.S. Pat. No. 3,946,266 issued to T. Saito et al. on Mar. 23, 1976 which shows single aperture focusing electrodes.

The presently disclosed gun construction, where the cathode assembly and control and screen grid electrodes are constructed as a single subassembly on a ceramic substrate, offers considerable advantages over prior art electron gun construction. In most prior art electron guns, each component is separately attached to the glass rods. Therefore, each is subjected to the heat required to soften the rods during assembly of parts. In the present embodiment, none of the components in the subassembly are subjected to this heat which is applied during an operation commonly called the beading operation. Because of this, none of the subassembly components are distorted as may occur in prior art tubes.

Figure 5:
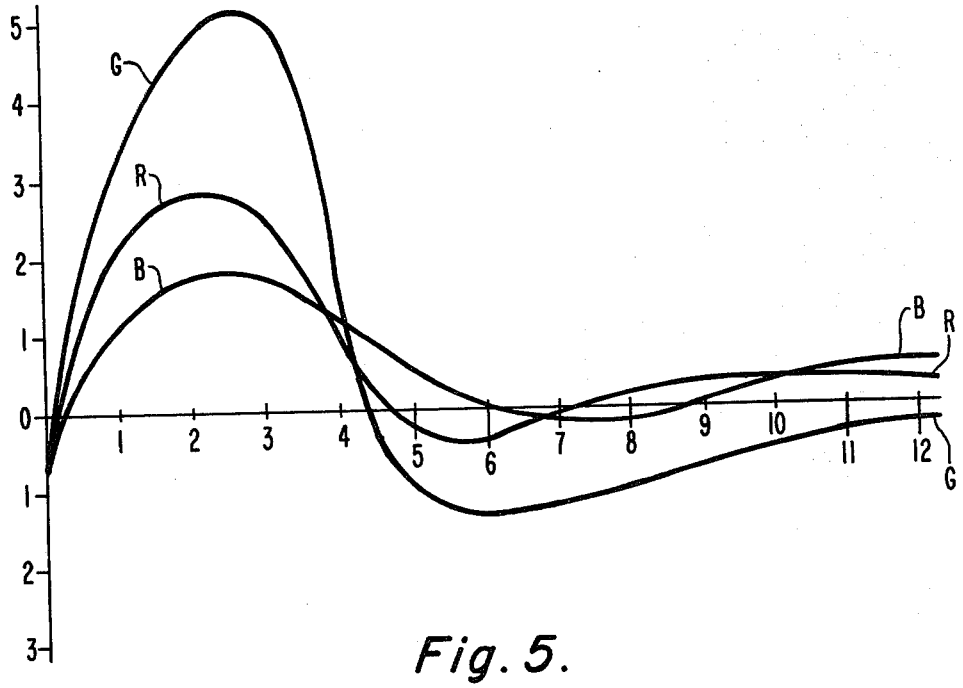
FIGS. 5 and 6 are graphs of cutoff voltage variations for a prior art gun and for a gun constructed in accordance with one embodiment of the present invention, respectively.
Figure 6:
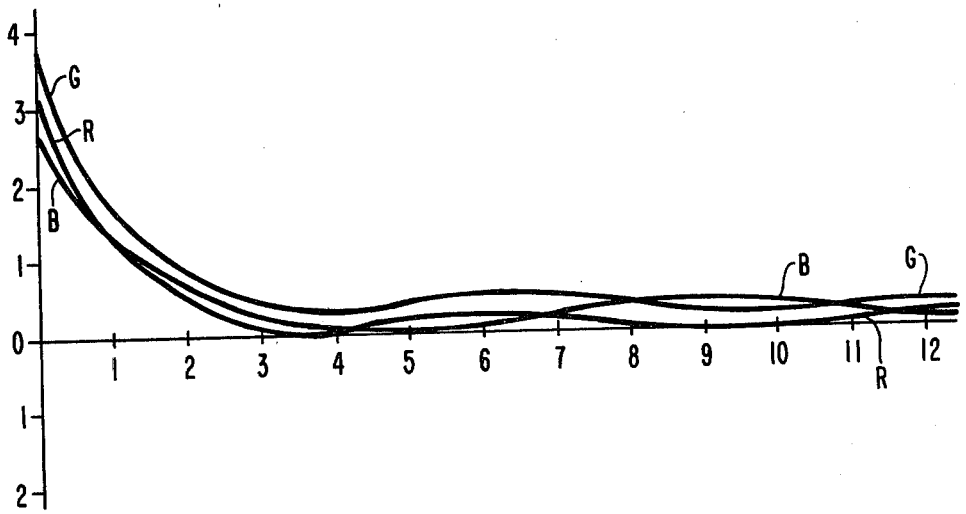

In one type of prior art electron gun, the cathode is constructed as a subassembly with a cup shaped control grid electrode. This subassembly, however, is separately attached to the glass rods from the screen grid attachment. During tube operation, the glass rods become heated and expand. Since the rods are separated, the heating of the rods may be somewhat dissimilar thereby causing a difference in expansion. This is only one possible mechanism that may cause variation in electrode spacings therefore resulting in variations in cutoff voltage of the beams. Such variation in cutoff voltage with increasing time from turn-on is shown in the graph of FIG. 5 for a typical prior art electron gun. The three curves represent the cutoff voltage variations for the three beams red (R), green (G) and blue (B). Within a particular gun and tube type, the relative positions of the curves as well as the magnitude of the curves may vary greatly. The mechanism causing these variations in cutoff voltages for the prior art guns is not fully understood. Since the variations are non-uniform for different tubes within a tube type, it is believed that a combination of factors may be involved. Such factors may include irregular heating of the glass beads thereby causing irregular expansion and/or some degree of oil canning of the grid electrodes as they are heated. The improvement that can be realized by incorporating an embodiment of the present invention into an electron gun is readily apparent from the graph of FIG. 6. All three beams track each other relatively closely during tube warmup. It is believed that this improvement in performance during tube warmup results from the combination of attachment of the three cathode assemblies and the control and screen grids to a single flat ceramic wafer and attachment of the ceramic subassembly to the glass beads in such manner that the uneven heating and expansion of the beads does not affect cathode-grid spacing.

I claim:

1. In a multi-beam electron gun for use in a cathode-ray tube, said gun including a plurality of cathode assemblies and at least two spaced successive electrodes having aligned apertures therein for passage of a plurality of electron beams, the improvement comprising, said cathode assemblies and the two electrodes being individually attached to a single ceramic member, said ceramic member being the sole supporting interconnection within said gun between said cathode assemblies and two electrodes, said two electrodes being attached to one surface of said ceramic member and the cathode assemblies being attached to an opposite surface of said ceramic member.

2. In a multi-beam electron gun for use in a cathode-ray tube, said gun including a plurality of cathode assemblies, a control grid electrode, a screen grid electrode and a plurality of other electrodes, the improvement comprising, the cathode assemblies and the control and screen grid electrodes being individually attached to a single ceramic wafer, the control and screen grid electrodes being surface-attached to the same side of the ceramic wafer, said control and screen grid electrodes each having projections of respectively different lengths, extending therefrom which contact and are surface-attached to the ceramic wafer, said projections being of predetermined length to establish a desired spacing between the control and screen grid electrodes.

3. The electron gun as defined in claim 2 wherein the projection on the control grid electrode is a circumferential rib and the projections on the screen grid electrode are flanges extending from ends of the screen grid electrode.

4. The electron gun as defined in claim 2 wherein the ceramic wafer is flat and includes metalized areas on surfaces thereof to which said cathode assemblies and control and screen grids are welded.

* * * * *